US006179056B1

(12) United States Patent
Smith

(10) Patent No.: US 6,179,056 B1
(45) Date of Patent: Jan. 30, 2001

(54) ARTIFICIAL LIFT, CONCENTRIC TUBING PRODUCTION SYSTEM FOR WELLS AND METHOD OF USING SAME

(75) Inventor: David Randolph Smith, Wassenaar (NL)

(73) Assignee: YPF International, Ltd., Cayman Islands ( * ) Notice: Under 35 U.S.C. 154(b), the term of this patent shall be extended for 0 days.

(21) Appl. No.: 09/241,721

(22) Filed: Feb. 2, 1999

Related U.S. Application Data

(60) Provisional application No. 60/073,626, filed on Feb. 4, 1998.

(51) Int. Cl.[7] ..... E21B 43/14; E21B 43/38

(52) U.S. Cl. ..... 166/313; 166/105.5; 166/106; 166/265; 166/370

(58) Field of Search ..... 166/105.5, 105.6, 166/106, 313, 370, 369, 265

(56) References Cited

U.S. PATENT DOCUMENTS

| | | | | |
|---|---|---|---|---|
| 1,547,194 | * | 7/1925 | Arbon | 166/106 |
| 2,242,166 | | 5/1941 | Bennett | 166/105 |
| 2,642,803 | | 6/1953 | Morris et al. | 166/54.1 |
| 2,678,605 | | 5/1954 | Tappmeyer | 166/54.1 |
| 2,799,226 | | 7/1957 | Kangas | 166/54.1 |
| 2,811,924 | | 11/1957 | Carpenter, Jr. et al. | 166/54.1 |
| 2,850,099 | * | 9/1958 | Brown | 166/127 |
| 2,852,079 | * | 9/1958 | Hebard | 166/147 |
| 2,905,099 | | 9/1959 | Turner | 166/68 |
| 3,080,922 | | 3/1963 | Mater | 166/114 |
| 3,115,185 | | 12/1963 | Brown | 166/119 |
| 4,793,408 | * | 12/1988 | Miffre | 166/53 |
| 4,898,244 | * | 2/1990 | Schneider et al. | 166/297 |
| 5,296,153 | * | 3/1994 | Peachey | 210/787 |
| 5,417,281 | * | 5/1995 | Wood et al. | 166/68 |
| 5,431,228 | * | 7/1995 | Weingarten et al. | 166/357 |
| 5,522,463 | * | 6/1996 | Barbee | 166/68 |
| 5,794,697 | * | 8/1998 | Wolflick et al. | 166/265 |

FOREIGN PATENT DOCUMENTS

| | | |
|---|---|---|
| 2297571 | 8/1996 | (GB) . |
| WO94/25729 | 11/1994 | (WO) . |

OTHER PUBLICATIONS

J.S. Weingarten, M.M. Kolpak, S.A. Mattison, and M.J. Williamson, SPE 30637—New Design for Compact Liquid–Gas Partial Separation: Downhole and Surface Installations for Artificial Lift Applications, 1995, pp. 1–9.

Krebs Petroleum Technologies, Auger Separator—Gas Liquid Separation, 2 pages (undated).

* cited by examiner

*Primary Examiner*—Hoang Dang
(74) *Attorney, Agent, or Firm*—Akin, Gump, Strauss, Hauer & Feld, LLP

(57) ABSTRACT

An artificial lift, concentric tubing production system for a well and method of using same. The system including an upper concentric tubing string portion comprising an inner production tubing string positioned within an outer production tubing string. A flow crossover assembly is connected to the upper concentric tubing string portion. The flow crossover assembly has first and second passageways. The inner production tubing string is in fluid communication with the first passageway and the outer production tubing string in fluid communication with the second passageway. An upper transducer is in fluid communication with one of the passageways of the flow crossover assembly and a lower apparatus is in fluid communication with the other of the passageways of the flow crossover assembly. The upper transducer may be a pump such as an electric submersible pump or a progressive cavity pump. The lower apparatus may be a pump, including an electric submersible pump, or a liquid/gas separator.

16 Claims, 7 Drawing Sheets

FIG.1C
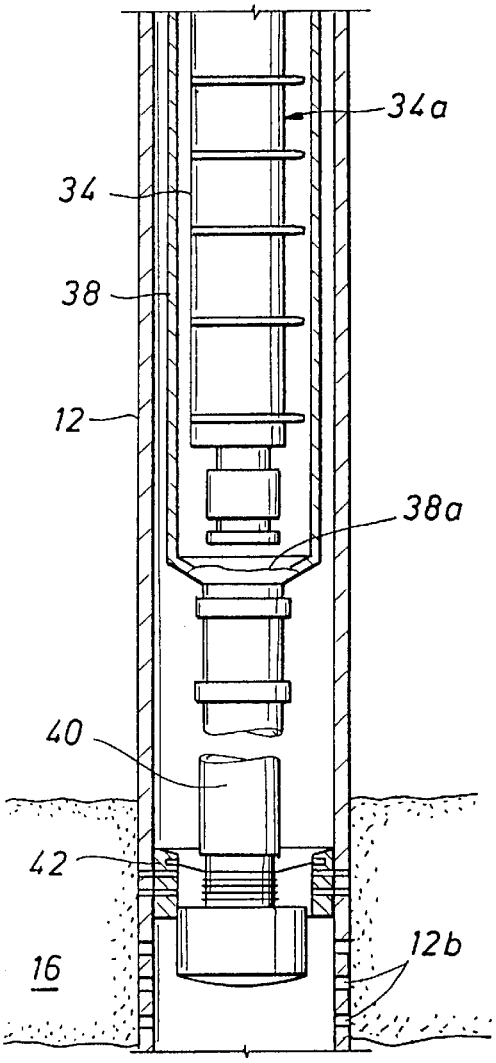
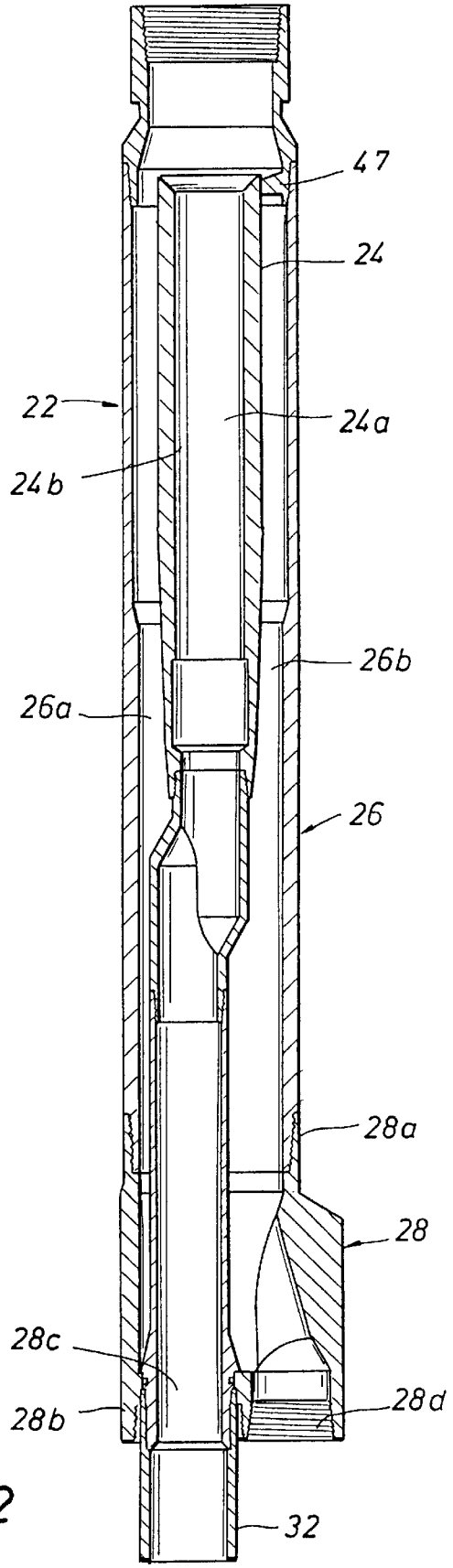
FIG. 2

ARTIFICIAL LIFT, CONCENTRIC TUBING PRODUCTION SYSTEM FOR WELLS AND METHOD OF USING SAME

CROSS-REFERENCE TO RELATED APPLICATIONS

This application claims the benefit of and priority from provisional patent application Ser. No. 60/073,626 filed Feb. 4, 1998.

BACKGROUND OF THE INVENTION

1. Field of the Invention

The present invention relates to artificial lift production systems and methods deployed in subterranean oil and gas wells, and more particularly relates to artificial lift production systems and methods having submersible transducers allowing two fluids to be produced separately.

2. Description of the Related Art

An oil producing reservoir or zone in a well has a natural pressure. A well that produces oil or gas by its own pressure is a flowing well. Stated another way, a flowing well is a well that is not being produced by the employment of transducers, such as pumps, or other artificial means. The natural pressure may not be sufficient to force the production fluid to the surface during the later or even from the beginning stages of the life of the well. In such instances, secondary methods of extracting the production fluid to the surface may be required to supplement the reservoir drive.

One type of secondary method of extracting the production fluid is through the use of an electric submersible pump, commonly referred to as an ESP. The ESP is lowered into the well and an electrical cable extends from the wellhead to the ESP. The ESP pumps the production fluid to the surface and aids in maximizing production from a low pressure or non-flowing well.

In many instances, two or more separate producing zones exist in a single well bore. In many of these multiple zone wells, it is desirable to produce the production fluids P1 and P2 from zones Z1 and Z2, respectively, concurrently and without commingling. For example, P1 and P2 may be at different reservoir pressures. If P2 has a higher pressure than P1 and they are produced commingled, the flow rate of the lower pressure reservoir P1 will be reduced because of the higher pressure of the other reservoir P2. Another example would be where one formation includes a corrosive gas or a damaging fluid that should not be commingled with the other formation. The two production fluids may not be compatible with each other. Yet another reason for producing without commingling is that certain regulatory agencies consider separated zones to be different fields and the operator has to report the flow rates from each individual reservoir. If the production fluids P1 and P2 are commingled downhole the operator has no way of accurately reporting the separate flow rates.

One option for producing two zones from a single well is for the operator to complete one zone for several years and then complete the second zone when the first zone is abandoned. Alternatively, the operator could drill a separate well for the second zone as opposed to waiting for several years and taking the risk that the economic value of the well may be significantly lower at that point in time. Thus, it is desirable to produce concurrently without commingling from two zones within a single well bore. It is even more desirable to be able to use an artificial lift system to separately produce fluids from multiple zones within a single well bore.

In an artificial lift system having a transducer, such as a submersible pump, the work required in the transducer is a finction of the volume being pumped. If the produced fluid includes both liquid and gas, the current state of the art places a liquid/gas separator on the transducer to remove the gas and reduce the fluid volume to be pumped by the transducer. The use of the separator to remove the gas allows the transducer to work more efficiently. However, it is to be understood that once that transducer fails it can only be replaced by pulling the combined transducer and separator assembly out of the well. Similarly, if the liquid/gas separator fails, the separator can only be replaced by pulling the combined transducer and separator assembly out of the well. Moreover, in many reservoirs where large amounts of gas are found with the associated liquids, the current state of the art requires the use of natural gas separation, and then placing the transducer below the resulting fluid level. Thus, it is also desirable to be able to use an artificial lift system to produce a gas and liquid production fluid from a single zone separately as a gas and a degassed fluid.

Various prior art patents disclose arrangements for producing from two separate zones in a single well. These patents include U.S. Pat. Nos. 3,115,185; 3,080,922; 2,905,099; 2,811,924; 2,799,226; 2,678,605; 2,642,803; and 2,242,166.

U.S. Pat. No. 3,115,185 discloses a dual completion apparatus having a pair of non-concentric tubing strings from the surface to a cylindrical upper body. The upper body has bores adapted to detachably receive the lower end of tubing strings. An outer pipe is attached to the lower end of the upper body, The lower portion of the outer pipe is sealingly engaged with an upper packer. An inner pipe is connected to the lower end of the bore in the upper body and extends through and below the outer pipe. The lower portion of the inner pipe is sealingly engaged with a lower packer. The lower packer is positioned above a lower zone and the upper packer is positioned above an upper zone. Production from the lower zone is produced through inner pipe and tubing string and production from the upper zone is produced through the annulus in outer pipe and tubing string.

U.S. Pat. No. 3,080,922 discloses a multiple zone well production apparatus having non-concentric dual tubing strings from the surface to a main head. The main head includes passages which are in fluid communication with the tubing strings. A lower string of tubing extends from the main head and through a lower packer for producing fluid from a lower zone below the packer. While not shown, it is suggested that suitable pumping equipment can be used in each tubing string to elevate the production to the top of the hole.

U.S. Pat. No. 2,905,099 discloses an oil well pumping apparatus for separately producing oil and gas from a lower producing zone in a dual zone well through concentric tubing.

U.S. Pat. No. 2,811,924 discloses an apparatus for separately and concurrently producing both oil and gas from two separate zones. A packer separates the two zones. Gas from the upper zone is produced through an upper pipe and oil from the upper zone is pumped by pumping jack through the production tubing. Gas from the lower zone is produced through an annulus between packer tubing and lower production tubing before entering the two-way crossover which diverts the gas to production tubing. Oil from the lower zone is pumped through the lower production tubing before entering the two-way crossover which diverts oil to production tubing.

U.S. Pat. No. 2,799,226 discloses a hydraulic pump assembly inserted in a tubing string. The pump assembly is adapted to remove fluid simultaneously from two separate zones without admixing the streams. Additionally, the pump assembly can be removed from the well without removing the entire well tubing.

U.S. Pat. No. 2,678,605 discloses a gas lift apparatus for producing oil from a multiple zone well. The oil is produced from separate zones through concentric tubing strings without admixing the streams. Gas lift valves are used to inject gas from the surface into the flowing oil stream to provide lifting action.

U.S. Pat. No. 2,642,803 discloses a dual production zone pump capable of pumping fluids simultaneously from spaced, subsurface formations while maintaining the pumped fluids segregated from each other.

U.S. Pat. No. 2,242,166 discloses an apparatus for employing two electric submersible pumps simultaneously in the same well for removing oil from two separate producing zones.

It is desirable to have an artificial lift system that allows for the concurrent and non-commingled production from more than one zone in the well bore of different pressures, fluids, gases, or solids using transducers, including transducers requiring an electrical power cable. It is also desirable that the artificial lift system include two electric submersible pumps with separate cables which are protected against damage during both installation and operation in the well. It is desirable that the electric submersible pumps be retrievable without having to retrieve the packer from the well bore. Additionally, it is important that the artificial lift system be capable of installation with a minimum of difficulty and risk of damage to the system as it is being installed. It is also desirable to have an artificial lift system that allows for the downhole separation of gas and degassed fluid and the separate production of each from a single zone.

SUMMARY OF THE INVENTION

The artificial lift system of the present invention relates to a unique arrangement of concentric production conduits or pipes and transducers deployed in subterranean oil and gas wells in such a manner to allow for produced materials or fluids to be separately produced. The separately produced fluids may be naturally separated in different zones in the well bore or the separation of fluids from a single zone may be induced in the well bore using the present invention. The artificial lift systems of the present invention include a flow crossover assembly having a lower transition or "Y"-tool member. The flow crossover assembly has an upper end adapted for mating with an upper concentric production tubing arrangement. The "Y-tool member has a lower end adapted to mate with two non-concentric lower tubing strings. Preferably, the upper end of the flow crossover assembly includes a sealing bore in an inner pipe to form a fluid seal with an inner production tubing string that can be run independently of an outer production tubing string of the upper concentric production tubing arrangement.

In a first embodiment of the present invention, the artificial lift system allows for the concurrent and non-commingled production from more than one zone in the well bore of different pressures, fluids, gases, or solids using transducers requiring an electric power cable. The artificial lift system includes two electric submersible pumps with separate cables that are protected against damage during both installation and operation in the well. Additionally, the electric submersible pumps are retrievable without retrieval of the packer from the well bore. In second and third embodiments of the present invention, the artificial lift system allows for the downhole separation and separate conduction of liquids and gas in the wellbore using a submersible transducer and a separator. The present embodiments of the artificial lift system can be installed with a minimum of difficulty and risk of damage to the system during installation while providing enhances operational features.

BRIEF DESCRIPTION OF THE DRAWINGS

In order to more fully understand the drawings referred to in the detailed description of the present invention, a brief description of each drawing is presented, in which:

FIGS. 1A, 1B and 1C are schematic, partial elevational sectional views of a first embodiment of the artificial lift, concentric tubing production system of the present invention with submersible transducers for separately producing fluids from separated production zones, FIG. 1A showing an upper portion, FIG. 1B showing a middle portion, and FIG. 1C showing a lower portion of the first embodiment of the artificial lift, concentric tubing production system;

FIG. 2 is an elevational sectional view of a flow crossover assembly of the artificial lift, concentric tubing production system;

DETAILED DESCRIPTION OF INVENTION

Figure 1A:
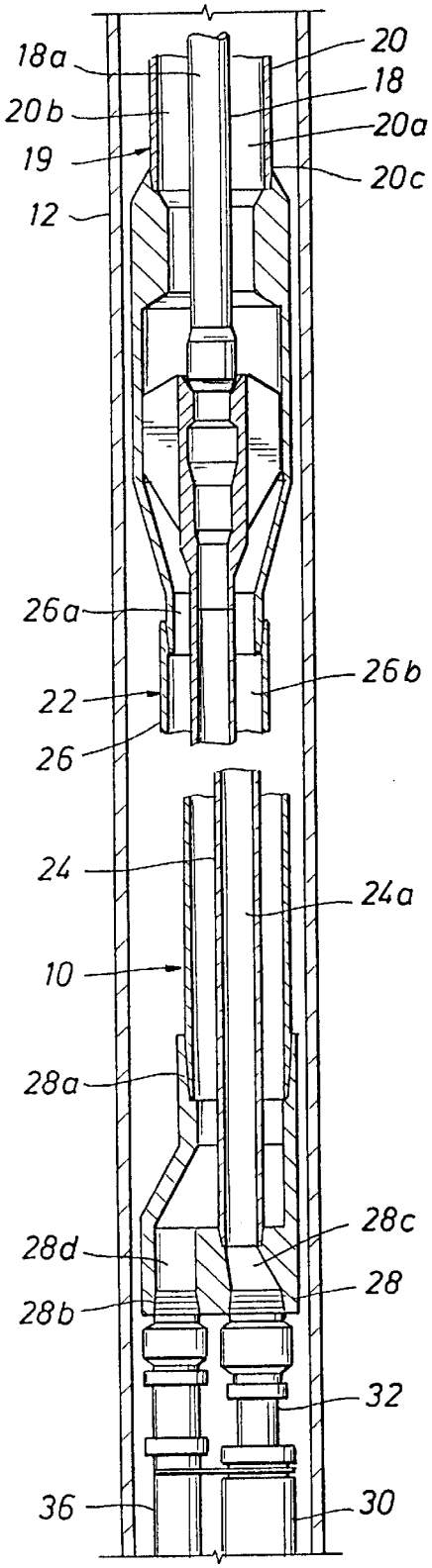
Figure 1B:
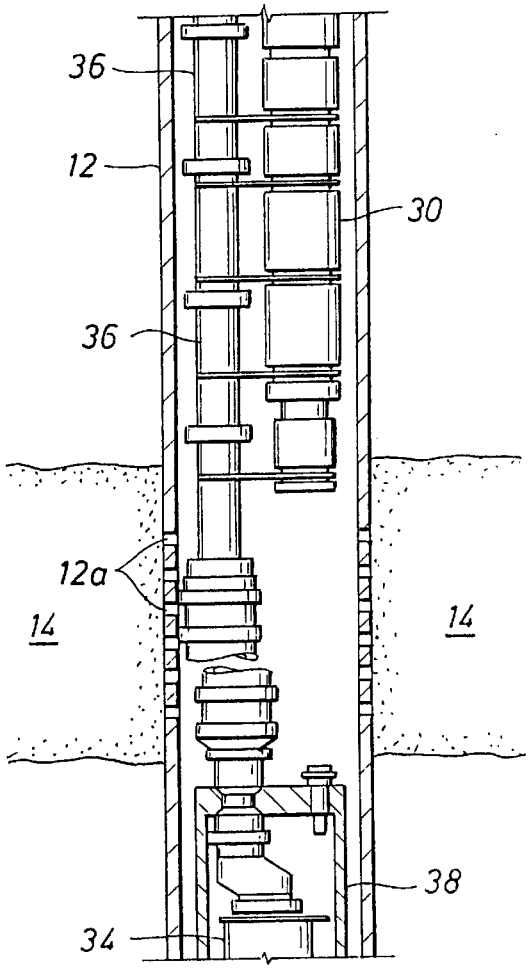

The first embodiment of the artificial lift, concentric tubing production system of the present invention, generally designated as reference 10, is shown in FIGS. 1A, 1B, and 1C. The artificial lift, concentric tubing production system 10, hereinafter referred to as "first system," is installed in a well bore or casing 12. The first system 10 is for use in a well in which it is desired to separately produce production fluids from upper and lower formations 14 (FIG. 1B) and 16 (FIG. 1C), respectively. The casing 12 includes perforations 12*a* and 12*b* at the elevations of the upper and lower formations 14 and 16, respectively.

Referring to FIG. 1A, the first system 10 includes an inner production tubing string 18 and an outer production tubing string 20 extending down from a wellhead (not shown). The inner production tubing string 18 has an inner tubing bore 18*a* and the outer production tubing string has an outer tubing bore 20*a*. Preferably, the inner production tubing string 18 is concentrically located within the outer production tubing string 20. Thus, the inner and outer production tubing strings 18 and 20, respectively, form a concentric tubing string 19. An annulus 20*b* is formed in the space between the inner and outer production tubing strings 18 and 20, respectively. It is to be understood that the outer production tubing string 20 has an outside diameter which is less than an inside diameter of the casing 12 as shown in FIG. 1A.

Still referring to FIG. 1A, a flow crossover assembly 22 is connected to a lower end 20*c* of the outer production tubing string 20. Referring to FIGS. 1A and 2, the flow crossover assembly 22 preferably includes inner and outer production pipes 24 and 26, respectively. The inner production pipe 24 has an inner pipe bore 24*a* and the outer production pipe 26 has an outer pipe bore 26*a*. An annulus 26*b* is formed in the space between the inner and outer production pipes 24 and 26, respectively. A transition or "Y"-tool member 28 is connected to the lower end of the inner and outer production pipes 24 and 26, respectively, of the flow crossover assembly 22. The "Y"-tool member 28 has an upper end 28*a* which is connected to the outer production pipe 26 and a lower end 28*b* having first and second passageways 28*c* and 28*d*, respectively, which are non-concentric but preferably parallel to one another.

In the first system 10 as shown in FIGS. 1A–1C, an upper transducer 30, such as an electric submersible pump (ESP), is in fluid communication with the first passageway 28*c*, the inner pipe bore 24*a*, and the inner tubing bore 18*a*. A spool piece 32 fluidly connects the upper ESP 30 to the flow crossover assembly 22 as shown in FIG. 1A.

Referring to FIGS. 1B and 1C, a lower transducer 34, such as an ESP, is in fluid communication with the second passageway 28*d*, the crossover annulus 26*b*, and the tubing annulus 20*b*. A lower tubing section 36 fluidly connects the lower transducer or ESP 34 to the flow crossover assembly 22 as shown in FIG. 1A.

It is to be understood that the upper and lower transducers 30 and 34, respectively, are not limited to electric submersible pumps but also include other types of pumps including progressive cavity pumps.

Still referring to FIGS. 1B and 1C, the lower ESP 34 is preferably housed within a capsule 38 for reasons which will be explained below. The capsule 38 includes a lower opening 38*a*. A lower stinger 40 is connected to the capsule 38 around the lower opening 38*a* and extends through an opening in a packer 42. The packer 42 forms a seal with the casing 12 above the lower perforations 12*b* and sealingly engages the lower stinger 40.

The production fluid from the lower formation 16 below the packer 42 passes through the lower perforations 12*b*, the lower stinger 40, and the lower opening 38*a* into the capsule 38. The lower formation production fluid is transduced through the lower ESP 34 and conducted through the lower tubing section 36, the second passageway 28*d*, the crossover annulus 26*b*, and the tubing annulus 20*b* to the surface.

The production fluid from the upper formation 14 (FIG. 1B) above the packer 42 passes through the upper perforations 12*a* and is transduced through the upper ESP 30 and conducted through the spool piece 32, the first passageway 28*c*, the inner pipe bore 26*a*, and the inner tubing bore 18*a* to the surface.

Thus, it is seen that the upper concentric tubing string 19 provides separate flowpaths to the surface for the production fluids from the formations 14 and 16. The tubing annulus 20*b* provides the flowpath for the fluid from the lower formation 16 while the inner tubing bore 18*a* provides the flowpath for the fluid from the upper formation 14. It is also understood that the lower ESP 34 transmits the fluid from the lower formation 16 whereas the upper ESP 30 transmits the fluid from the upper formation 14.

In the first embodiment of the present invention 10, the lower ESP 34 is preferably positioned above the packer 42 as shown in FIG. 1C. This allows the ESPs 30 and 34 and electrical hardware to be retrieved to the surface without retrieving the packer 42 and also allows the packer 42 to be accurately set at the correct depth in the casing 12. Alternatively, the packer 42 could be positioned above the lower ESP 34 and run down with the lower ESP 34. With the lower ESP 34 positioned above the packer 42, the capsule 38 provides pressure isolation between the two zones 14 and 16. A suction inlet 34*a* (FIG. 1C) to the lower ESP 34 is typically located along the side of the lower ESP 34. Thus, the fluid from the lower zone 16 passes through the lower stinger 40 and begins to fill the capsule 38. The fluid is drawn into the suction inlet 34*a* and discharged into the lower tubing section 36. The capsule 38 prevents fluid from the upper formation 14 from entering the suction inlet 34*a* of the lower ESP 34 while providing a chamber for the lower formation fluid above the packer and before being transduced by the lower ESP 34.

Electric submersible pumps require electric power. Thus, if the upper and lower transducers 30 and 34, respectively, are electric submersible pumps, they require electric power. In such a situation, it is preferable to have separate and unique control of the upper ESP 30 and the lower ESP 34. Thus, preferably a separate electric power cable (not shown) is run for each ESP 30, 34 from the wellhead or surface down to the ESP 30, 34. Preferably, the electric power cable for each ESP 30, 34 is run along the outside surface of the outer production tubing string 20 and the flow crossover assembly 22 and down to the respective ESP 30 or 34. This allows the electric power cables to be out of the flow path of the high pressure fluids discharged from the ESPs 30, 34 since the high pressure fluids are within the lower piping 32 and 36, the flow crossover assembly 22, and the concentric tubing string 19. This feature is desirable as it prevents electric power cable failures caused by contact with high pressure pump discharge fluids. It is additionally preferable from an installation standpoint as will be explained below.

Another obstacle to having more than one transducer in a non-flowing well is the difficulty with installation and the risk of damaging some components before reaching the desired location in the well. The first system 10 reduces both the difficulty and the risks involved. Preferably, the inner production tubing string 18 is run independently from the outer production tubing string 20. The lower stinger 40, capsule 38 with lower ESP 34, lower tubing section 36, upper ESP 30, spool piece 32, flow crossover assembly 22, and the ESP power cables (not shown) are all deployed on the outer production tubing string 20 as one assembly. The packer 42 can be deployed either with this assembly or deployed prior to this assembly via common industry methods such as wireline or tubing.

Figure 3:
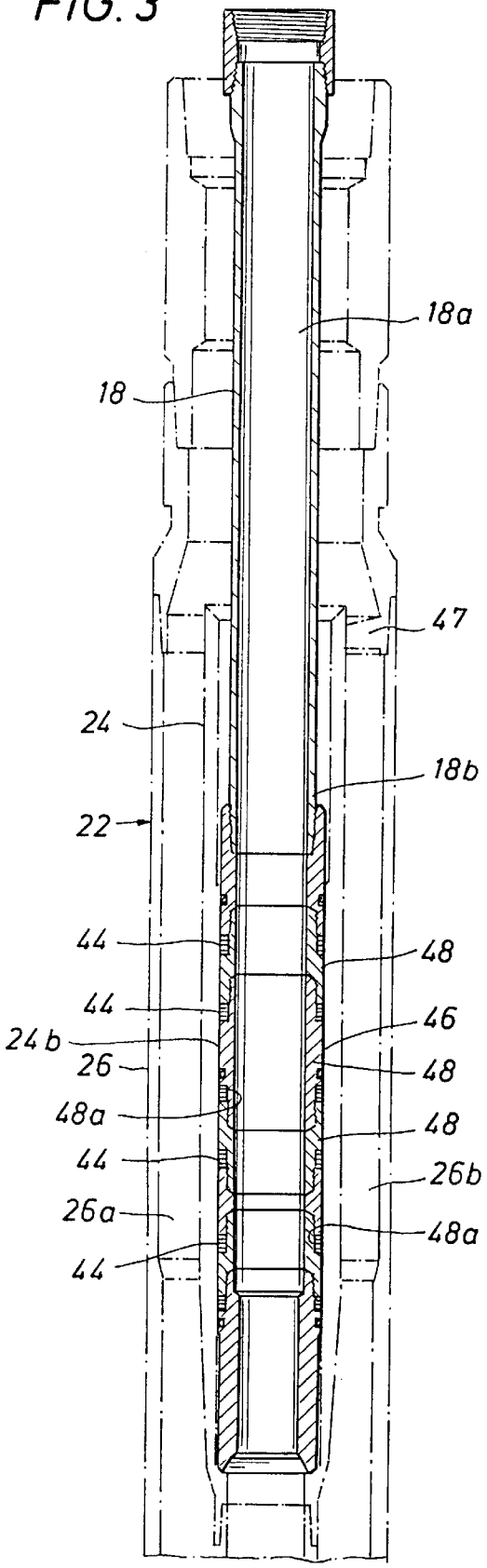
FIG. 3 is a partial elevational sectional view of a stinger assembly connected to the upper portion of the flow crossover assembly shown in FIG. 2.

As stated above, the inner production tubing string 18 is run independently from the outer production tubing string 20 after the above assembly has been installed. Referring to FIGS. 2 and 3, a sealing bore 24*b* is placed inside of the upper portion of the inner production pipe 24 within the flow crossover assembly 22. This sealing bore 24*b* has a smooth internal surface that allows for a set of seals 44 (FIG. 3), as for example O-rings, run on a tubing adapter stinger 46 at the lower end 18*b* of the inner production tubing string 18 to form a fluid and pressure seal. Thus, the pressure and fluid coming through the inner production pipe 24 of the flow crossover assembly 22 is prevented from mixing with the fluid flowing in the outer production pipe 26. The upper end of the inner production pipe 24 is preferably maintained concentrically located within the outer production pipe 26 with a centralizer 47. This will allow easier stabbing of the tubing adapter stinger 46 in the inner production pipe 24. As shown in FIG. 3, the tubing adapter stinger 46 may comprise a number of short pup sections 48 which are threadably joined together and having seal grooves 48*a* for receiving the seals 44. The tubing adapter stinger 46 is retained in position by the weight of the inner production tubing string 18. The integrity of the seal can be tested by landing a wireline plug (not shown) in the lower end of the sealing bore 24*b* and pressurizing the inner production tubing string 18.

The sealing assembly between the tubing adapter stinger 46 and the sealing bore 24*b* of the inner production pipe 24 provides for the inner production tubing string 18 to be run in the well bore independently of the outer production tubing string 20, and provides for the inner production tubing string 18 to be run into and out of the well at a different time than outer production tubing string 20.

The use of the concentric tubing string 19 allows for the deployment of more than one electric cable, and more than one transducer on a single tubing string, while producing the production fluids of different formations 14 and 16 in different production tubing. In this case, the inner production tubing string 18 and inner production pipe 24 are not connected to the ESP power cable and the inner production tubing string 18 can be pulled out or run into the well independently of the outer production tubing string 20. This simplifies the deployment of two or more ESP power cables, as the ESP power cables are only connected to the outer production pipe 26 and the outer production tubing string 20.

Additionally, this concentric method of deployment allows for the use of an electric submersible pump 34 with its associated electric cable to produce one interval or formation 16, while a second transducer 30, for example, a positive displacement pump, is run in or out of the hole on the inner production tubing string 18 separately and independently of the outer production tubing string 20 and the ESP transducer 34.

Figure 4A:
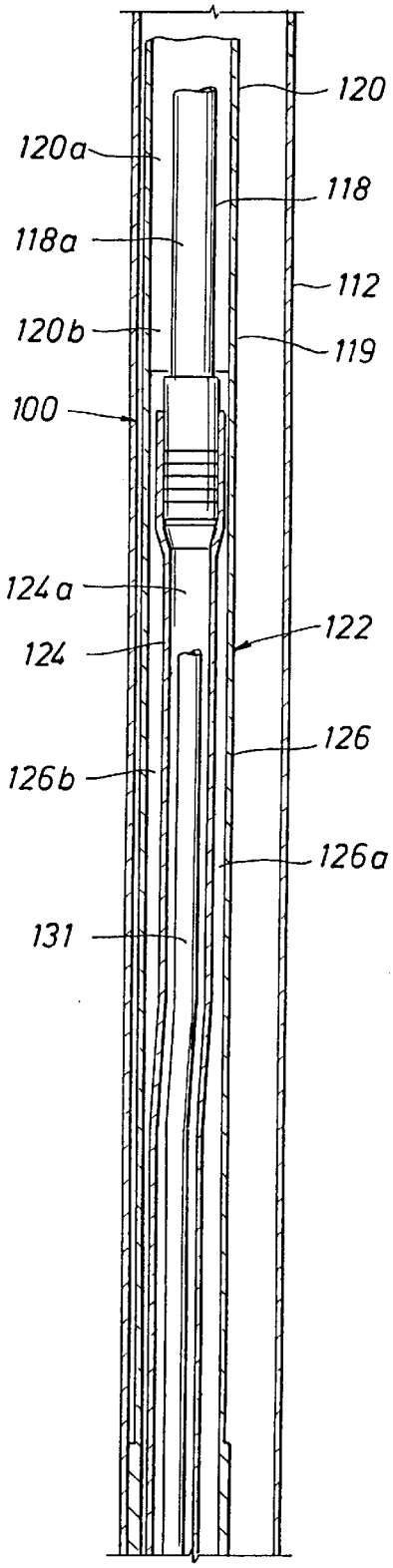
FIGS. 4A, 4B and 4C are schematic, partial elevational sectional views of a second embodiment of the artificial lift, concentric tubing production system of the present invention with a submersible transducer and a liquid/gas separator for separately producing fluids from a production zone, FIG. 4A showing an upper portion, FIG. 4B showing a middle portion, and FIG. 4C showing a lower portion of the second embodiment of the artificial lift, concentric tubing production system.
Figure 4B:
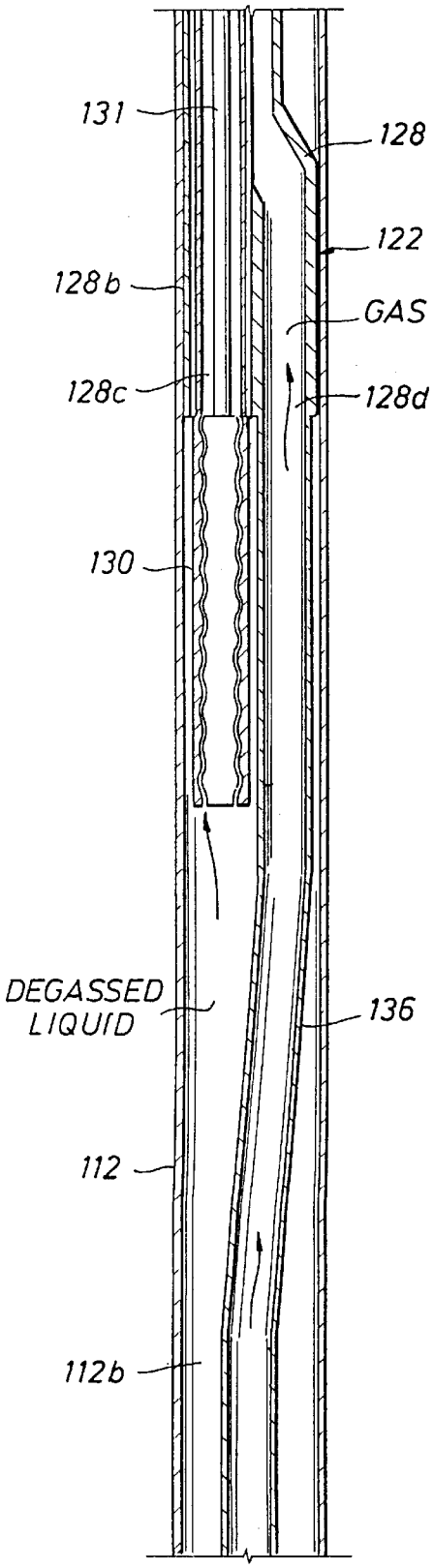
Figure 4C:
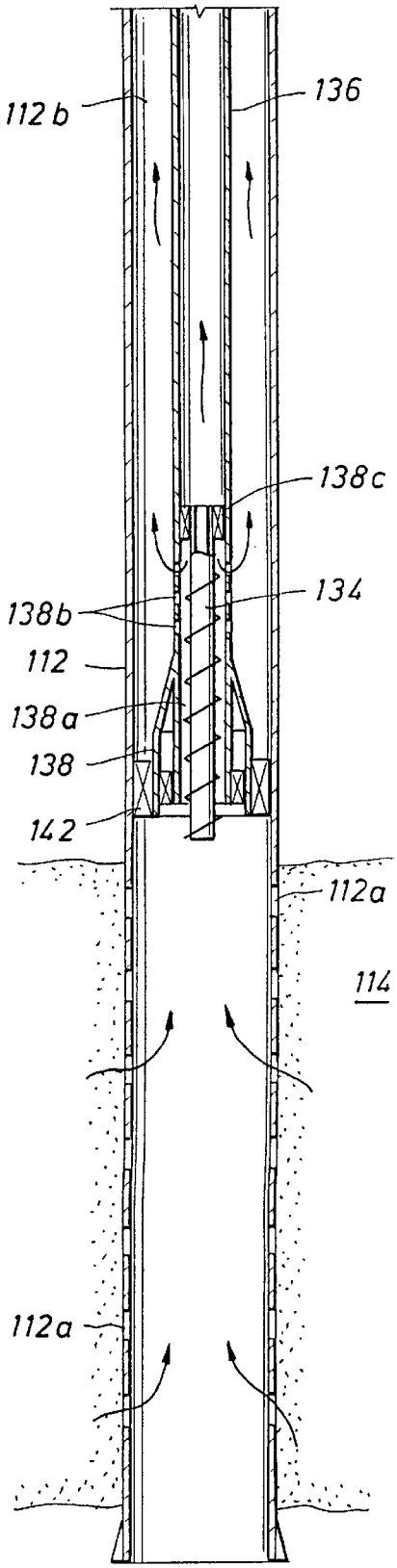

The second embodiment of the artificial lift, concentric tubing production system of the present invention, generally designated as reference 100, is shown in FIGS. 4A–4C. The artificial lift, concentric tubing production system 100, hereinafter referred to as "second system," is installed in a well bore or casing 112. The second system 100 is for use in a well in which it is desired to separately produce production fluids from a formation 114 (FIG. 4C). The second system 100 allows for the downhole separation and separate conduction of liquids and gases in the wellbore using a submersible transducer and separator. The casing 112 includes perforations 12*a* at the elevation of the formation 114.

Referring to FIG. 4A, the second system 100 includes an inner production tubing string 118 and an outer production tubing string 120 extending down from a wellhead (not shown). The inner production tubing string 118 has an inner tubing bore 118*a* and the outer production tubing string 120 has an outer tubing bore 120*a*. Preferably, the inner production tubing string 118 is concentrically located within the outer production tubing string 120. Thus, the inner and outer production tubing strings 118 and 120, respectively, form a concentric tubing string 119. An annulus 120*b* is formed in the space between the inner and outer production tubing strings 118 and 120, respectively. It is to be understood that the outer production tubing string 120 has an outside diameter which is less than an inside diameter of the casing 112 as shown in FIG. 4A.

Referring to FIGS. 4A and 4B, a flow crossover assembly 122 is connected to the outer production tubing string 120. Referring to FIGS. 4A and 4B, the flow crossover assembly 122 preferably includes inner and outer production pipes 124 and 126, respectively. The inner production pipe 124 has an inner pipe bore 124*a*and the outer production pipe 126 has an outer pipe bore 126*a*. An annulus 126*b* is formed in the space between the inner and outer production pipes 124 and 126, respectively. Referring to FIG. 4B, a transition or "Y"-tool member 128 is connected to the lower end of the inner and outer production pipes 124 and 126, respectively, of the flow crossover assembly 122. The "Y"-tool member 128 has a lower end 128*b* having first and second passageways 128*c* and 128*d*, respectively, which are non-concentric but preferably parallel to one another.

In the second system 100 as shown in FIGS. 4A–4C, an upper transducer 130, such as a progressive cavity pump (as shown in FIG. 4B) or an electric submersible pump, is in fluid communication with the first passageway 128*c*, the inner pipe bore 124*a*, and the inner tubing bore 118*a*. The progressive cavity pump 130 includes a sucker rod 131 extending upwardly through the inner pipe bore 124*a* and the inner tubing bore 118*a*.

Referring to FIGS. 4B and 4C, a lower apparatus 134, such as a liquid/gas separator, is in fluid communication with the second passageway 128*d*, the crossover annulus 126*b*, and the tubing annulus 120*b*. A lower tubing section 136 fluidly connects the lower apparatus or liquid/gas separator 134 to the flow crossover assembly 122 as shown in FIGS. 4B and 4C. It is to be understood that the lower apparatus 134 is preferably, although not limited to, an auger-type liquid/gas separator which is well known to those of ordinary skill in the art.

Referring to FIG. 4C, the lower apparatus or liquid/gas separator 134 is preferably contained within a separator receptacle 138 at the lower end of the lower tubing section 136. The separator receptacle 138 includes a bore 138*a* therethrough. The upper portion of the separator receptacle 138 includes perforations 138*b* through the wall of the receptacle 138. The upper end of the liquid/gas separator 134 is secured to the separator receptacle 138 above the perforations 138*b* with a packer 138*c*. The lower portion of the separator receptacle 138 is sealingly engaged with the casing 112 above the casing perforations 112*a* with a packer 142.

The production fluids from the formation 114 comprise both gas and liquid. The gas and liquid fluid passes through the perforations 112*a* below the packer 142 and enter the liquid/gas separator 134 at the separator receptacle 138. The liquid/gas separator 134 separates and discharges the gas in the bore of the lower tubing section 136. The gas passes through the second passageway 128*d*, the crossover annulus 126*b*, and the tubing annulus 120*b* to the surface.

The liquid/gas separator 134 separates and discharges the liquid or degassed fluid through the receptacle perforations 138*b* and into a casing annulus 112*b* above the packer 142. The low pressure degassed fluid rises to the level of the upper transducer 130 in the casing annulus 112*b*. The degassed fluid is transduced through the upper transducer 130 and conducted through the first passageway 128*c*, the inner pipe bore 126*a*, and the inner tubing bore 118*a* to the surface.

Thus, it is seen that the upper concentric tubing string 119 provides separate flow paths to the surface for the production fluids from the formation 114. The tubing annulus 120*b* provides the flow path for the gas while the inner tubing bore 118*a* provides the flow path for the degassed fluid. Furthermore, it is to be understood that the second system 100 includes a single packer 142 positioned below the upper transducer 130 and lower apparatus 134.

Figure 5A:
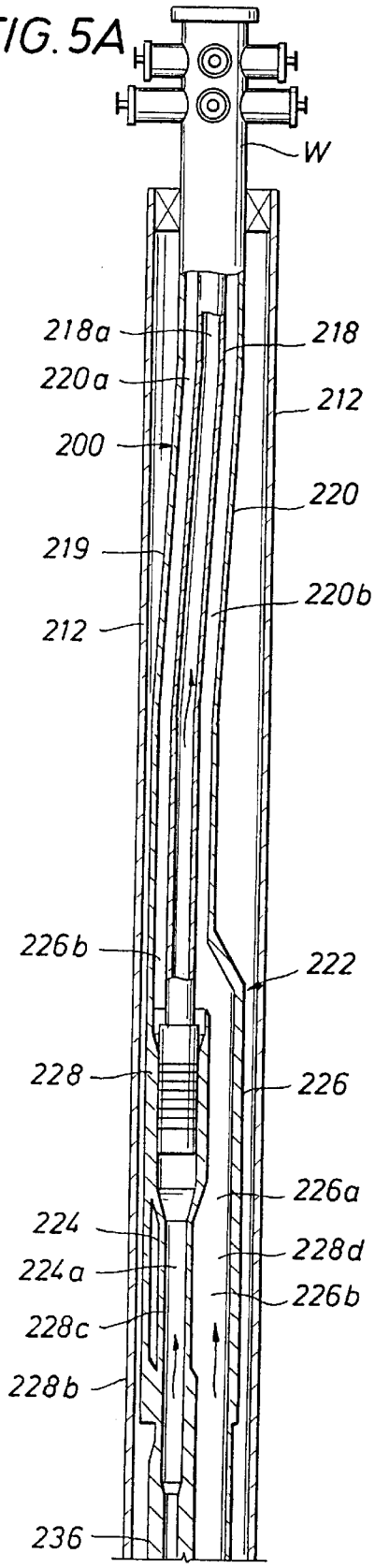
FIGS. 5A, 5B, 5C and 5D are schematic, partial elevational sectional views of a third embodiment of the artificial lift, concentric tubing production system of the present invention with a submersible transducer and a liquid/gas separator for separately producing fluids from a production zone, FIG. 5A showing an upper portion, FIG. 5B showing an upper middle portion, FIG. 5C showing a lower middle portion, and FIG. 5D showing a lower portion of the third embodiment of the artificial lift, concentric tubing production system.
Figure 5B:
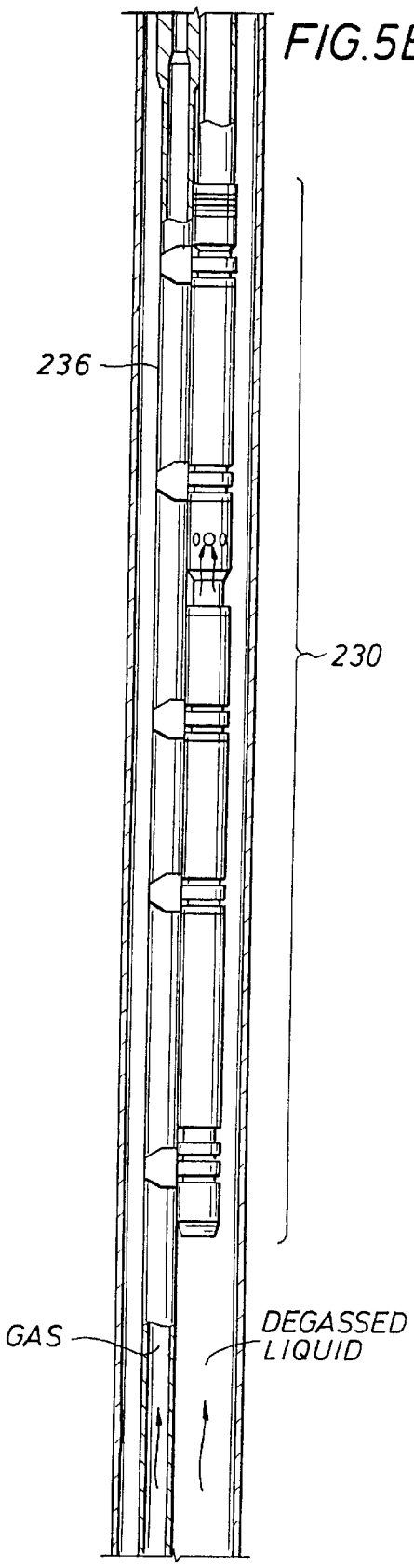
Figure 5C:
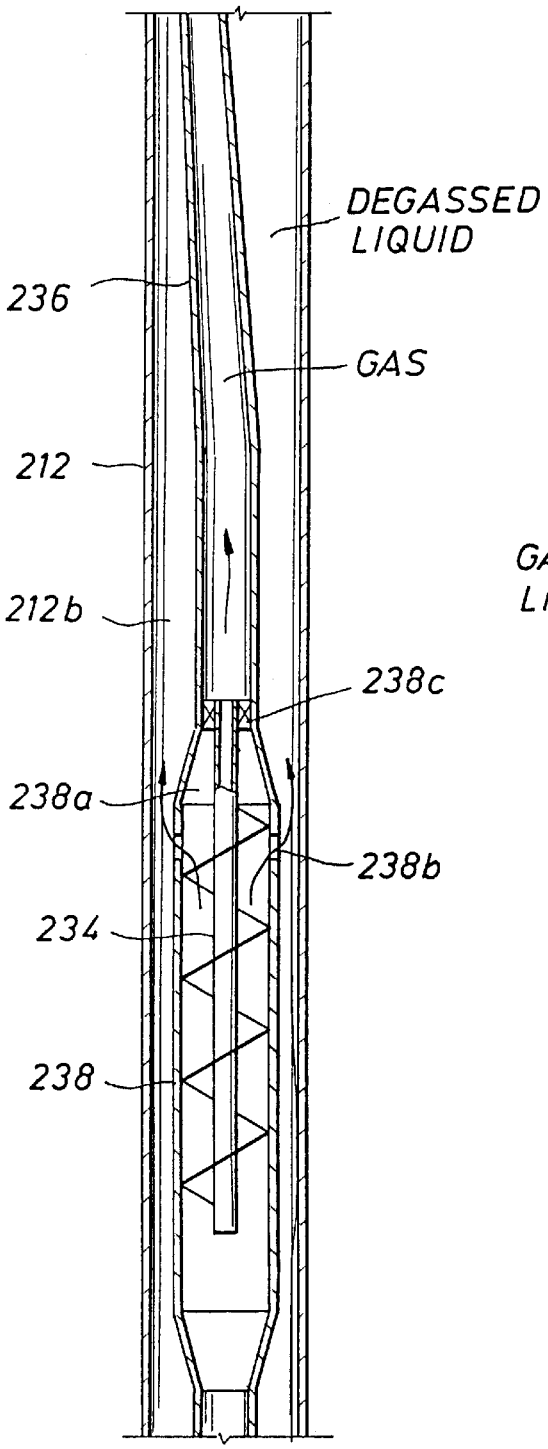
Figure 5D:
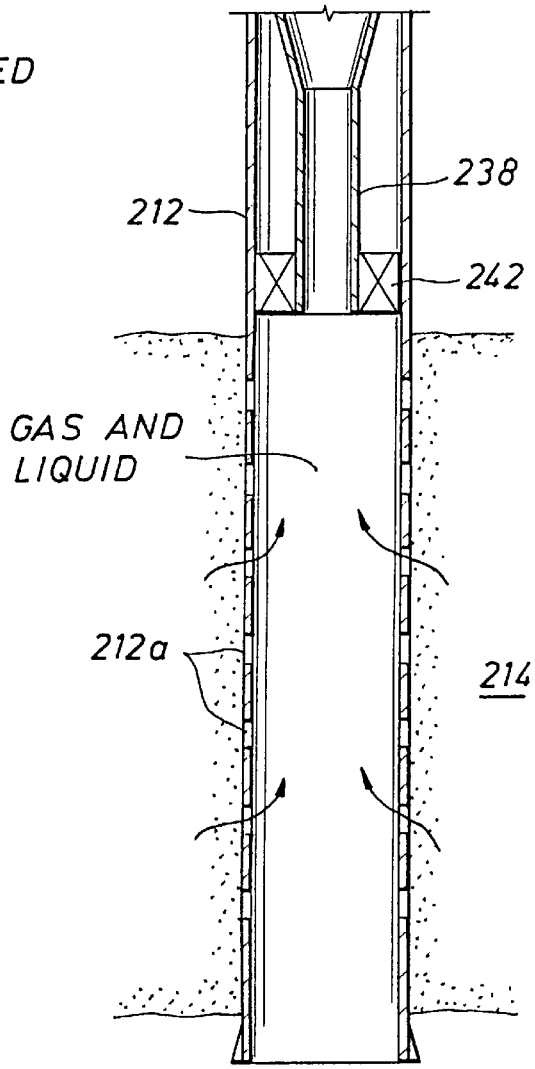

The third embodiment of the artificial lift, concentric tubing production system of the present invention, generally designated as reference 200, is shown in FIGS. 5A–5D. The artificial lift, concentric tubing production system 200, hereinafter referred to as "third system," is installed in a well bore or casing 212. The third system 200, like the second system 100, is for use in a well in which it is desired to separately produce production fluids from a formation 214 (FIG. 5D). The third system 200 allows for the downhole separation and separate conduction of liquids and gases in the wellbore using a submersible transducer and separator. The third system 200 is very similar to the second system 100. The casing 212 includes perforations 212*a* at the elevation of the formation 214.

Referring to FIG. 5A, the third system 200 includes an inner production tubing string 218 and an outer production tubing string 220 extending down from a wellhead W. The inner production tubing string 218 has an inner tubing bore 218*a* and the outer production tubing string 220 has an outer tubing bore 220*a*. Preferably, the inner production tubing string 218 is concentrically located within the outer production tubing string 220. Thus, the inner and outer production tubing strings 218 and 220, respectively, form a concentric tubing string 219. An annulus 220*b* is formed in the space between the inner and outer production tubing strings 218 and 220, respectively. It is to be understood that the outer production tubing string 220 has an outside diameter which is less than an inside diameter of the casing 212 as shown in FIG. 5A.

Referring to FIG. 5A, a flow crossover assembly 222 is connected to the outer production tubing string 220. The flow crossover assembly 222 preferably includes inner and outer production pipes 224 and 226, respectively. The inner production pipe 224 has an inner pipe bore 224*a* and the outer production pipe 226 has an outer pipe bore 226*a*. An annulus 226*b* is formed in the space between the inner and outer production pipes 224 and 226, respectively. Referring to FIG. 5A, a transition or "Y"-tool member 228 is connected to the lower end of the inner and outer production pipes 224 and 226, respectively, of the flow crossover assembly 222. The "Y"-tool member 228 has a lower end 228*b* having first and second passageways 228*c* and 228*d*, respectively, which are non-concentric but preferably parallel to one another.

In the third system 200 as shown in FIGS. 5A–5D, an upper transducer 230, such as an electric submersible pump or ESP (as shown in FIG. 5B), is in fluid communication with the second passageway 228*d*, the crossover annulus 226*b*, and the tubing annulus 220*b*.

Referring to FIGS. 5A–5C, a lower apparatus 234, such as a liquid/gas separator (FIG. 5C), is in fluid communication with the first passageway 228*c*. It is to be understood that the lower apparatus 234 is preferably, although not limited to, an auger-type liquid/gas separator which is well known to those of ordinary skill in the art. A lower tubing section 236 fluidly connects the lower apparatus or liquid/gas separator 234 to the flow crossover assembly 222 as shown in FIGS. 5A–5C.

Referring to FIGS. 5C and 5D, the lower apparatus or liquid/gas separator 234 is preferably contained within a separator receptacle 238 at the lower end of the lower tubing section 236. The separator receptacle 238 includes a bore 238*a* therethrough. The upper portion of the separator receptacle 238 includes perforations 238*b* through the wall of the receptacle 238. The upper end of the liquid/gas separator 234 is secured to the separator receptacle 238 above the perforations 238*b* with a packer 238*c*. The lower portion of the separator receptacle 238 is sealingly engaged with the casing 212 above the casing perforations 212*a* with a packer 242.

The production fluids from the formation 214 comprise both gas and liquid. Referring to FIG. 5D, the gas and liquid fluid passes through the perforations 212*a* below the packer 242 and enter the liquid/gas separator 234 at the separator receptacle 238. The liquid/gas separator 234 separates and discharges the gas in the bore of the lower tubing section 236. The gas passes through the first passageway 228*c*, to the inner tubing bore 218*a* and to the wellhead W.

The liquid/gas separator 234 separates and discharges the liquid or degassed fluid through the receptacle perforations 238*b* and into a casing annulus 212*b* above the packer 242. The low pressure degassed fluid rises to the level of the upper transducer 230 in the casing annulus 212*b* . The degassed fluid is transduced through the upper transducer 230 and conducted through the second passageway 228*d*, and the tubing annulus 220*b* to the wellhead W.

Thus, it is seen that the upper concentric tubing string 219 provides separate flow paths to the surface for the production fluids from the formation 214. The tubing annulus 220*b* provides the flow path for the degassed fluid or liquid while the inner tubing bore 218*a* provides the flow path for the gas.

Figure 6:
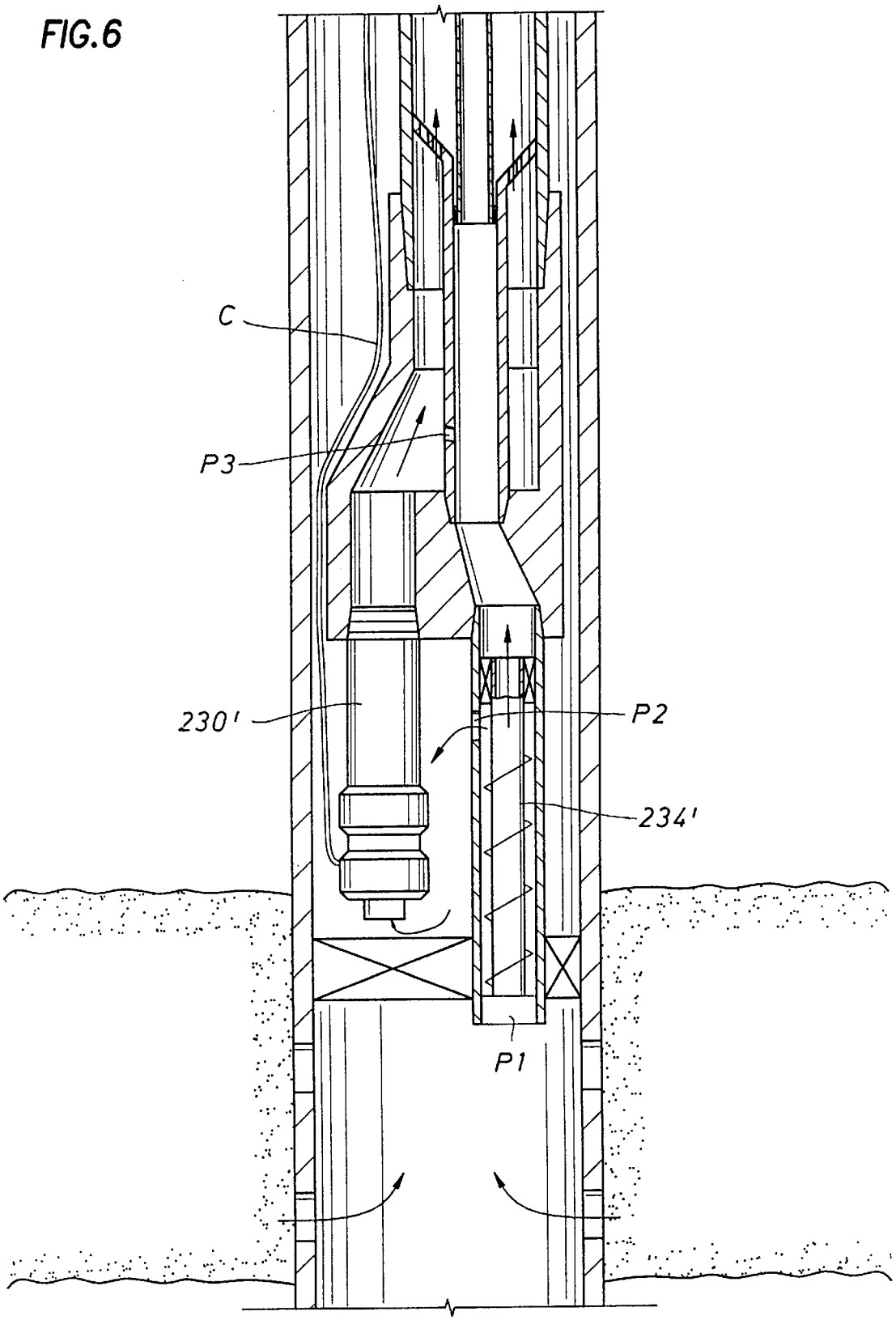
FIG. 6 is an alternative arrangement of the lower portion of the third embodiment of the artificial lift, concentric tubing production system.

It is to be understood that the second system 100 and third system 200 provide for the downhole separation and separate conduction of liquids and gases in the wellbore using a submersible transducer and separator. FIG. 6 is an alternative arrangement of the lower portion of the third system 200 having downhole monitoring equipment. By using downhole monitoring equipment the performance of the transducer 230' can be monitored on the surface, and interactively controlled to speed up the flow through the liquid/gas separator 234'. With reference to FIG. 6, this is accomplished by the control of a throttle valve (not shown) at P1, control of an actuated valve (not shown) at P2, or by the pressure drop achieved across the liquid/gas separator 234' by changing the rate of the transducer 230'. Hence by using the system of concentric tubing and separating the liquid/gas separator 234' from the transducer 230', a controlled submersible separation process can be deployed in a well bore. If the separator 234' is damaged or needs to be changed due to changes in the interval's production, or any other reason, the separator 234' is changed without requiring the changing of the transducer 230' and its associated equipment.

The systems 100 and 200 and as shown in FIG. 6 provide a method of separating gas from liquid downhole in combination with a submersible transducer in such a manner as to bypass the gas around the upper submersible transducer, control the separation process downhole, and make the gas separation equipment retrievable from the wellbore independent of the retrieval of the submersible transducer. This allows the use of transducers in a well where the currently available gas separation equipment is deficient (and causes severe efficiency losses in the transducers due to gas compression). By connecting the liquid/gas separator to a separate concentric conduit, and forcing all the reservoir fluids to pass through the separator prior to contacting the fluid transducer, the present invention offers a significant amount of control of the separation process, while enhancing the extraction of the gas, due to increased velocity in the smaller tubing, and simultaneously removing the gas from contact with the fluid transducer. The liquid/gas separation device is further enhanced by the use of the transducer to develop the required and controlled pressure drop across the liquid/gas separation device. This avoidance of gas contact with the fluid transducer is significant for the electric submersible transducer power cable C (FIG. 6), located on the outer diameter of the outer concentric string, as it reduces damage to the transducer's power cable typically induced by gas corrosion, erosion, impregnation, and the damage due to associated products of gas production, for example scales and other precipitates.

It is also envisioned that the expanding gas that is separated from the production stream can be used to augment the fluid lifting capacity of the fluid transducer in the well. With reference to FIG. 6, this can be accomplished by diverting a portion of the expanding gas into the production conduit connected to the discharge of the fluid transducer 230' at P3 to induce a gas lift effect. Moreover, the use of the expanding gas in the concentric string can be manipulated to thermodynamically cool downhole instruments and electric motors.

It is to be understood that the present invention allows for the simultaneous separate production of more than one zone in a well bore of different pressures, fluids, gases, or solids using transducers, including transducers that require electric power cables.

It is to be understood that the embodiments of the present invention allow for the running and pulling of the inner concentric string independent of the outer string, due to the unique combination of the flow crossover assembly with "Y"-tool convergence in combination with the sealing adapter for the inner concentric string. This invention further allows the inner concentric string to deploy a mechanically, or hydraulically powered transducer or apparatus that can be pulled or run from the well without disturbing the electric submersible transducer and the outer concentric tubing string.

This invention also allows for the forced separation of liquids and gas by the combination of the liquid/gas separation equipment, downhole monitoring equipment, the inner concentric tubing string, and the deployment and retrieval of the liquid/gas separation equipment without retrieving the transducer. Moreover, the invention's placement of the packer, and liquid/gas separation device with the "Y"-tool convergence allows for all liquids and gases to be forced through the separation device, and to use the transducer and its control devices like variable speed drives, as well as other downhole valves, and measurement instruments, to control the separation process.

The present invention also allows for the forced and controlled separation of liquids and gases and subsequent conduction of the separated products in concentric tubing strings thus allowing for the expanding gas to assist in lifting fluids from the discharge of the transducer. This technique provides a means of using gas lifting techniques and submersible transducer techniques in the same well bore.

This present invention further provides for the use of expanding gas for thermodynamic cooling of devices deployed in the well bore. Currently, all electrical, optical, and electronic equipment run into well bores have a run life dependent of the temperatures in the well bore. This invention yields a refrigeration method for downhole devices.

The foregoing disclosure and description of the invention are illustrative and explanatory thereof, and various changes in the details of the illustrated apparatus and construction and method of operation may be made without departing from the spirit of the invention.

What is claimed is:

1. An artificial lift, concentric tubing production system for a well comprising:

an upper concentric tubing string portion comprising an inner production tubing string positioned within an outer production tubing string;

a flow crossover assembly connected to said upper concentric tubing string portion, said flow crossover assembly having first and second passageways, said inner production tubing string in fluid communication with said first passageway and said outer production tubing string in fluid communication with said second passageway;

an electric submersible pump in fluid communication with one of said passageways of said flow crossover assembly; and a lower apparatus in fluid communication with the other of said passageways of said flow crossover assembly.

2. The system of claim 1, wherein said lower apparatus is an electric submersible pump.

3. The system of claim 1, wherein said lower apparatus is a liquid/gas separator.

4. An artificial lift, concentric tubing production system for a well comprising:

an upper concentric tubing string portion comprising an inner production tubing string positioned within an outer production tubing string;

a flow crossover assembly connected to said upper concentric tubing string portion, said flow crossover assembly having first and second passageways, said inner production tubing string in fluid communication with said first passageway and said outer production tubing string in fluid communication with said second passageway;

a progressive cavity pump in fluid communication with one of said passageways of said flow crossover assembly; and a lower apparatus in fluid communication with the other of said passageways of said flow crossover assembly.

5. The system of claim 4, wherein said lower apparatus is a liquid/gas separator.

6. An artificial lift, concentric tubing production system for a well comprising:

an upper concentric tubing string portion comprising an inner production tubing string positioned within an outer production tubing string, said inner production tubing string including a tubing adapter stinger;

a flow crossover assembly connected to said upper concentric tubing string portion, said flow crossover assembly having first and second passageways, said inner production tubing string in fluid communication with said first passageway and said outer production tubing string in fluid communication with said second passageway, said flow crossover assembly including an inner production pipe having a sealing bore and said tubing adapter stinger being adapted to sealingly engage said sealing bore;

an upper transducer in fluid communication with one of said passageways of said flow crossover assembly; and a lower apparatus in fluid communication with the other of said passageways of said flow crossover assembly.

7. The system of claim 6, wherein said tubing adapter stinger includes a plurality of seals to form a fluid and pressure seal with said sealing bore of said inner production pipe.

8. The system of claim 6, wherein said inner production tubing string is adapted to be installed separately from said outer production tubing string.

9. An artificial lift, concentric tubing production system for a well having an upper formation with an upper production fluid, a lower formation with a lower production fluid, and a casing perforated at each formation, the system comprising:

an upper concentric tubing string portion comprising an inner production tubing string positioned within an outer production tubing string;

a flow crossover assembly connected to said upper concentric tubing string portion, said flow crossover assembly having first and second passageways, said inner production tubing string in fluid communication with said first passageway and said outer production tubing string in fluid communication with said second passageway;

an upper transducer in fluid communication with one of said passageways of said flow crossover assembly;

a lower apparatus in fluid communication with the other of said passageways of said flow crossover assembly;

a capsule containing said lower apparatus, said capsule having an upper outlet in fluid communication with one of said passageways of said flow crossover assembly and a lower inlet attached to a stinger; and a packer set in the casing between the upper and lower formations, said packer forming a seal with the casing and said stinger;

wherein the lower production fluid is produced separately from the upper production fluid, the lower production fluid is produced via said lower apparatus and the upper production fluid is produced via said upper transducer.

10. The system of claim 9, further comprising a first power cable attached to an exterior of said outer production tubing string, said first power cable connected to said upper transducer.

11. The system of claim 10, further comprising a second power cable attached to said exterior of said outer production tubing string, said second power cable connected to said lower apparatus.

12. An artificial lift, concentric tubing production system for a well including a formation having a combination gas and liquid fluid and a casing perforated at the formation, the system comprising:

an upper concentric tubing string portion comprising an inner production tubing string positioned within an outer production tubing string;

a flow crossover assembly connected to said upper concentric tubing string portion, said flow crossover assembly having first and second passageways, said inner production tubing string in fluid communication with said first passageway and said outer production tubing string in fluid communication with said second passageway;

an upper transducer in fluid communication with one of said passageways of said flow crossover assembly;

a lower apparatus in fluid communication with the other of said passageways of said flow crossover assembly;

a capsule containing said lower apparatus, said lower apparatus comprising a separator, said capsule having an upper outlet in fluid communication with one of said passageways of said flow crossover assembly and a lower inlet, said capsule including perforations in an upper end of said capsule; and a packer set in the casing above the formation, said packer forming a seal with the casing and said capsule lower inlet;

wherein the combination gas and liquid fluid is directed through said separator and a separated gas exits said separator through said capsule upper outlet and is directed through and to one of said flow crossover assembly passageways and a degassed liquid exits said separator through said capsule perforations.

13. The system of claim 12, wherein said separator is capable of being removed from the well independently of said upper transducer.

14. A method of using an artificial lift, concentric tubing production system for wells comprising the steps of:

lowering into a well bore a downhole assembly comprising an outer production tubing string portion connected to a flow crossover assembly having connected thereto an upper transducer in fluid communication with a first flow crossover passageway and a lower apparatus in fluid communication with a second flow crossover passageway, the first and second flow crossover passageways of the flow crossover assembly are concentric at the upper portion and non-concentric and parallel at the lower portion of the flow crossover assembly;

installing an inner production tubing string within the outer production tubing string; and forming a releasable sealing engagement between the inner production tubing string and the first flow crossover passageway.

15. A method of using an artificial lift, concentric tubing production system for wells comprising the steps of:

lowering into a well bore a downhole assembly comprising an outer production tubing string portion connected to a flow crossover assembly having connected thereto an upper transducer in fluid communication with a first flow crossover passageway and a lower apparatus in fluid communication with a second flow crossover passageway;

installing an inner production tubing string within the outer production tubing string after the downhole assembly has been fully lowered into the well bore; and forming a releasable sealing engagement between the inner production tubing string and the first flow crossover passageway.

16. A method of using an artificial lift, concentric tubing production system for wells comprising the steps of:

lowering into a well bore a downhole assembly comprising an outer production tubing string portion connected to a flow crossover assembly having connected thereto a pump in fluid communication with a first flow crossover passageway and a separator in fluid communication with a second flow crossover passageway;

installing an inner production tubing string within the outer production tubing string;

forming a releasable sealing engagement between the inner production tubing string and the first flow crossover passageway; and allowing retrieval of the separator independently of the pump.

* * * * *